US012012835B2

(12) United States Patent
Fripp et al.

(10) Patent No.: US 12,012,835 B2
(45) Date of Patent: Jun. 18, 2024

(54) DISSOLVABLE EXPENDABLE GUNS FOR PLUG-AND-PERF APPLICATIONS

(71) Applicant: Halliburton Energy Services, Inc., Houston, TX (US)

(72) Inventors: Michael Linley Fripp, Carrollton, TX (US); Christopher C. Hoelscher, Arlington, TX (US); Brenden Michael Grove, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 275 days.

(21) Appl. No.: 17/606,898

(22) PCT Filed: May 8, 2020

(86) PCT No.: PCT/US2020/032229

§ 371 (c)(1),
(2) Date: Oct. 27, 2021

(87) PCT Pub. No.: WO2020/236442

PCT Pub. Date: Nov. 26, 2020

(65) Prior Publication Data

US 2022/0205343 A1 Jun. 30, 2022

Related U.S. Application Data

(60) Provisional application No. 62/852,108, filed on May 23, 2019, provisional application No. 62/852,129,
(Continued)

(51) Int. Cl.
*E21B 43/117* (2006.01)
*E21B 23/06* (2006.01)
(Continued)

(52) U.S. Cl.
CPC ..... *E21B 43/261* (2013.01); *E21B 23/06* (2013.01); *E21B 23/08* (2013.01); *E21B 33/12* (2013.01);
(Continued)

(58) Field of Classification Search
CPC .... E21B 43/117; E21B 43/261; E21B 43/267; E21B 33/1294; E21B 33/134; E21B 47/092; E21B 2200/08
See application file for complete search history.

(56) References Cited

U.S. PATENT DOCUMENTS 3,078,797 A 2/1963 Blair
4,244,424 A 1/1981 Talbot
(Continued)

FOREIGN PATENT DOCUMENTS

CN 107013181 A 8/2017
EP 1264075 B1 6/2018
(Continued)

OTHER PUBLICATIONS

International Search Report and The Written Opinion of the International Search Authority, or the Declaration, Aug. 25, 2020, PCT/US2020/032229, 12 pages, ISA/KR.
(Continued)

*Primary Examiner* — Giovanna Wright
*Assistant Examiner* — Ronald R Runyan
(74) *Attorney, Agent, or Firm* — John Wustenberg; C. Tumey Law Group PLLC

(57) ABSTRACT

A wellbore system for perforating a subterranean formation including a dissolvable perforating gun that may be wirelessly operated to fire at a predetermined wellbore location and thereafter fragmented and dissolved with wellbore fluids. The perforating gun may take the form of a strip gun with an elongated rod or other charge holder carrying a
(Continued)

plurality of exposed perforating charges thereon. The exposed shaped charges may each be equipped with an individual charge cover or filler material disposed over a liner that forms a jet when the shaped charge is detonated. A wiper to facilitate pumping the perforating gun through the wellbore and may include an initiator for detecting a signal or condition indicative of the perforating gun having reached a predetermined location to cause the perforating gun to fire.

20 Claims, 6 Drawing Sheets

Related U.S. Application Data filed on May 23, 2019, provisional application No. 62/852,153, filed on May 23, 2019, provisional application No. 62/852,161, filed on May 23, 2019.

(51) Int. Cl.

| | |
|---|---|
| ***E21B 23/08*** | (2006.01) |
| ***E21B 33/12*** | (2006.01) |
| ***E21B 33/129*** | (2006.01) |
| ***E21B 33/13*** | (2006.01) |
| ***E21B 33/134*** | (2006.01) |
| ***E21B 34/06*** | (2006.01) |
| ***E21B 34/14*** | (2006.01) |
| ***E21B 43/116*** | (2006.01) |
| ***E21B 43/12*** | (2006.01) |
| ***E21B 43/26*** | (2006.01) |
| ***E21B 43/267*** | (2006.01) |
| ***E21B 43/27*** | (2006.01) |
| ***E21B 47/092*** | (2012.01) |
| ***E21B 47/095*** | (2012.01) |
| ***E21B 47/26*** | (2012.01) |

(52) U.S. Cl.

CPC ..... *E21B 33/1294* (2013.01); *E21B 33/13* (2013.01); *E21B 33/134* (2013.01); *E21B 34/063* (2013.01); *E21B 34/14* (2013.01); *E21B 43/116* (2013.01); *E21B 43/117* (2013.01); *E21B 43/12* (2013.01); *E21B 43/267* (2013.01); *E21B 43/27* (2020.05); *E21B 47/092* (2020.05); *E21B 47/095* (2020.05); *E21B 47/26* (2020.05); *E21B 2200/08* (2020.05)

(56) References Cited

U.S. PATENT DOCUMENTS

| | | | | |
|---|---|---|---|---|
| 6,786,157 | B1 * | 9/2004 | Powell | F42D 3/00 102/306 |
| 7,332,416 | B2 | 1/2008 | Burris, II et al. | |
| 7,363,967 | B2 | 4/2008 | Burris, II et al. | |
| 8,276,670 | B2 | 10/2012 | Patel | |
| 8,342,094 | B2 | 1/2013 | Marya et al. | |
| 8,496,052 | B2 | 7/2013 | Frazier | |
| 8,677,903 | B2 | 3/2014 | Marya et al. | |
| 9,133,695 | B2 | 9/2015 | Xu | |
| 9,217,319 | B2 | 12/2015 | Frazier et al. | |
| 9,464,508 | B2 | 10/2016 | Lerche et al. | |
| 9,587,475 | B2 | 3/2017 | Frazier et al. | |
| 9,671,201 | B2 | 6/2017 | Marya et al. | |
| 9,695,677 | B2 | 7/2017 | Moody-Stuart et al. | |
| 9,797,238 | B2 | 10/2017 | Frosell et al. | |
| 9,799,238 | B2 | 10/2017 | Frosell et al. | |
| 9,920,621 | B2 | 3/2018 | Frosell et al. | |
| 9,963,955 | B2 | 5/2018 | Tolman et al. | |
| 10,082,008 | B2 | 9/2018 | Robey et al. | |
| 2005/0241835 | A1 * | 11/2005 | Burris | E21B 23/10 166/313 |
| 2012/0152519 | A1 | 6/2012 | Rodgers et al. | |
| 2013/0062055 | A1 | 3/2013 | Tolman et al. | |
| 2013/0292174 | A1 | 11/2013 | Harvey et al. | |
| 2014/0027127 | A1 | 1/2014 | Frazier et al. | |
| 2014/0310940 | A1 * | 10/2014 | Grattan | F42B 1/036 427/407.1 |
| 2015/0247382 | A1 | 9/2015 | Murphree et al. | |
| 2015/0275643 | A1 | 10/2015 | Holder et al. | |
| 2015/0345255 | A1 | 12/2015 | Onuoha | |
| 2016/0040520 | A1 | 2/2016 | Tolman et al. | |
| 2017/0175500 | A1 | 6/2017 | Robey et al. | |
| 2017/0234103 | A1 | 8/2017 | Frazier | |
| 2017/0314372 | A1 | 11/2017 | Tolman et al. | |
| 2018/0163503 | A1 | 6/2018 | Fripp et al. | |
| 2018/0171744 | A1 | 6/2018 | Markel et al. | |
| 2020/0370421 | A1 | 11/2020 | Fripp et al. | |
| 2021/0404305 | A1 * | 12/2021 | Winkler | E21B 43/261 |

FOREIGN PATENT DOCUMENTS

| | | | | |
|---|---|---|---|---|
| WO | WO-2013184238 | A1 | 12/2013 | |
| WO | WO-2018013131 | A1 | 1/2018 | |
| WO | WO-2019229520 | A1 * | 12/2019 | E21B 43/117 |

OTHER PUBLICATIONS

Examination Report issued for United Kingdom Patent Application No. GB2113196.6, dated Jul. 29, 2022, 9 pages.

Search Report and Written Opinion issued for International Patent Application No. PCT/US2020/026222, dated Jul. 27, 2020, 13 pages, ISA/KR.

Search Report and Written Opinion issued for International Patent Application No. PCT/US2020/032229, dated Aug. 25, 2020, 12 pages, ISA/KR.

Search Report and Written Opinion issued for International Patent Application No. PCT/US2020/032255, dated Aug. 12, 2020, 17 pages, ISA/KR.

Search Report and Written Opinion issued for International Patent Application No. PCT/US2020/032257, dated Aug. 20, 2020, 15 pages, ISR/KR.

* cited by examiner

DISSOLVABLE EXPENDABLE GUNS FOR PLUG-AND-PERF APPLICATIONS

CROSS REFERENCE TO RELATED APPLICATIONS

The present application is a U.S. National Stage patent application of International Patent Application No. PCT/US2020/032229 entitled Dissolvable Expendable Guns for Plug-and-Perf Applications, filed on May 8, 2020, which claims priority to U.S. Provisional Application No. 62/852,161 entitled Dissolvable Expendable Guns for Plug-and-Perf Applications, filed May 23, 2019, the disclosure of which is hereby incorporated by reference. This application also claims priority to U.S. Provisional Application Nos. 62/852,108, entitled "Locating Self-Setting Dissolvable Plugs," 62/852,129 entitled Dissolvable Setting Tool for Hydraulic Fracturing Operations and 62/852,153 entitled Acid Fracturing with Dissolvable Plugs each filed on May 23, 2019, the disclosures of each of which are hereby incorporated by reference.

BACKGROUND

The present disclosure relates generally to equipment and operations for use in a subterranean wellbore. More specifically, the disclosure relates to equipment and operations for perforating a wellbore with a perforating gun.

After drilling each section of a subterranean wellbore that traverses one or more hydrocarbon bearing subterranean formations, individual lengths of metal tubulars are typically secured together to form a casing string that is positioned within the wellbore. This casing string provides wellbore stability to counteract the geomechanics of the formation such as compaction forces, seismic forces and tectonic forces, thereby preventing the collapse of the wellbore wall. Conventionally, the casing string is cemented within the wellbore. To produce fluids into the casing string, hydraulic openings or perforations must be made through the casing string and a distance into the formation.

Typically, these perforations are created by detonating a series of shaped charges that are disposed within the casing string and are positioned adjacent to the formation. Specifically, one or more perforating guns are loaded with shaped charges that are connected with a detonator via a detonating cord. The perforating guns are then connected within a tool string that is lowered into the cased wellbore at the end of a tubing string, wireline, slick line, coil tubing or other conveyance. Once the perforating guns are properly positioned in the wellbore such that the shaped charges are adjacent to the formation to be perforated, the shaped charges may be detonated, thereby creating the desired hydraulic openings. Thereafter, the consumed perforating guns are returned to the surface. It may be difficult, time consuming and expensive to deliver and retrieve a perforating gun, for example, to and from the end of a horizontal wellbore section using these traditional methods.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes a wellbore system for perforating a subterranean formation including a dissolvable perforating gun that may be wirelessly operated to fire at a predetermined wellbore location and thereafter fragmented and dissolved with wellbore fluids. As used herein, the term "wirelessly" at least indicates that the perforating gun may be operated at a downhole location without a wired communication line or other physical connection to a surface location. For example, a perforating gun operating wirelessly may detect a condition or signal originating from within the wellbore at the downhole location, or the perforating gun may be responsive to a telemetry signal transmitted through a fluid in the wellbore or through the surrounding geologic formation.

The perforating gun may include a wiper to facilitate pumping the perforating gun through the wellbore untethered from any tubular sting, wireline or other physical conveyance extending to the surface location. The perforating gun may include an initiator for detecting a signal or condition indicative of the perforating gun having reached a predetermined location to cause the perforating gun to fire. The initiator may, for example, detect a magnetic coupling in a casing string or may detect the landing of the perforating gun in a frac plug. The perforating gun may take the form of a strip gun with an elongated rod or other charge holder carrying a plurality of exposed perforating charges thereon. The exposed shaped charges may each be equipped with an individual charge cover or filler material disposed over a liner that forms a jet when the shaped charge is detonated. The perforating gun may include an additional electronics explosive such as a shaped charge or detonator cord adjacent the initiator to fragment an electronics package in the initiator once the shaped charges have fired. The fragmented initiator, the charge holder and other components of the perforating gun may be constructed of materials that permit the perforating gun to dissolve within two weeks of deployment in wellbore fluids.

Illustrative embodiments and related methodologies of the present disclosure are described below in reference to FIGS. 1-7 as they might be employed. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

Figure 1:
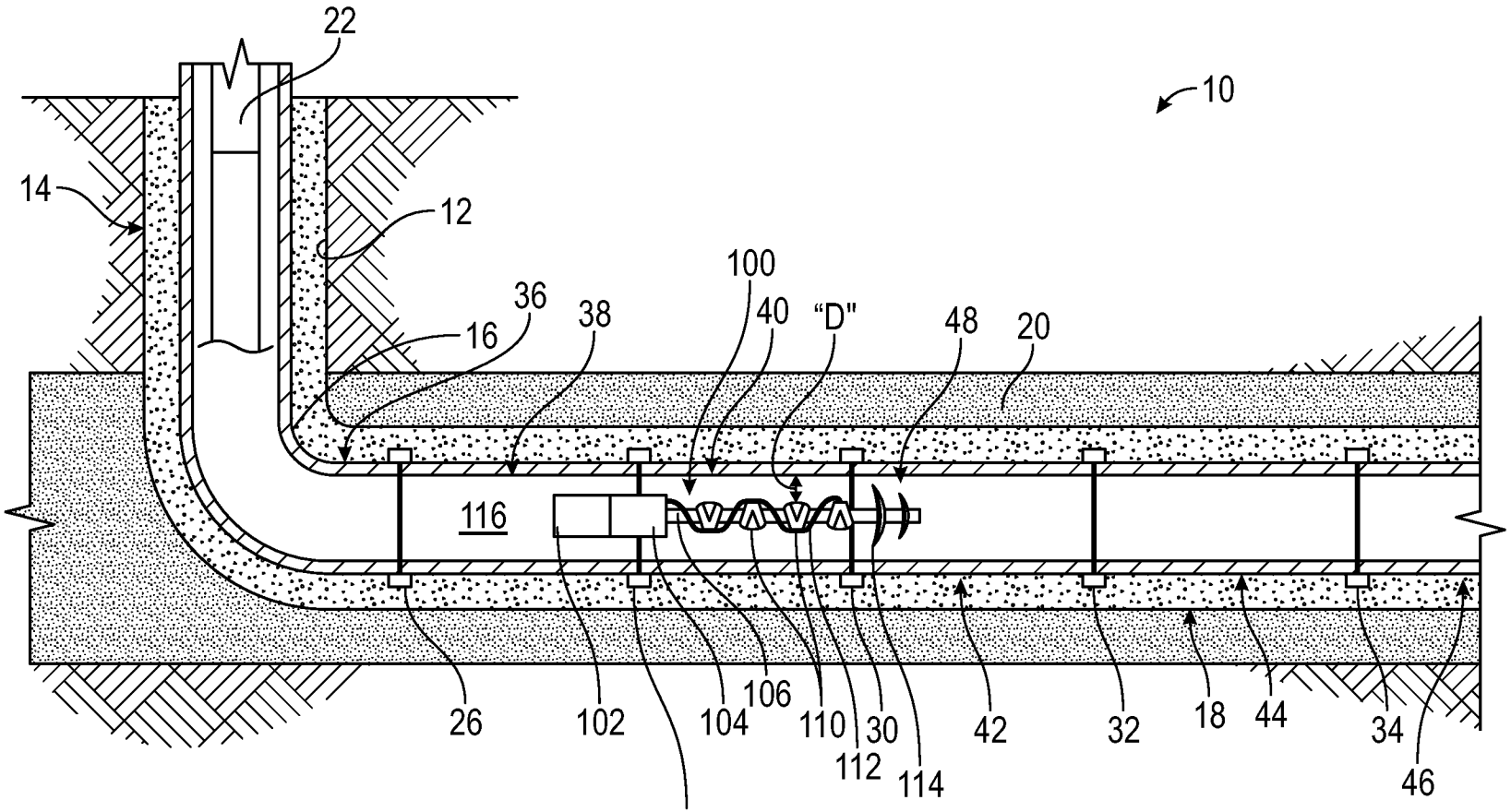
FIG. 1 is a schematic illustration of a wellbore system employing an untethered perforating gun, which may be wirelessly operated, for example, operated without a wired or physical connection to a surface location, at a predetermined position in the wellbore and subsequently dissolved within the wellbore in accordance with one or more example embodiments of the present disclosure.

FIG. 1 is a schematic illustration of a wellbore system 10 in which an untethered dissolvable perforating gun 100 is deployed in a wellbore 12 according to an embodiment of the present disclosure. The perforating gun 100 is generally arranged to be pumped untethered into position in the wellbore 12. For example, the perforating gun 100 may be pumped through the wellbore 12 in a carrier fluid without being tethered to a tubular string or other conveyance to propel the perforating gun 100 into position from a surface location. Once in position, the perorating gun 100 is generally arranged for wireless activation. For example, the perforating gun 100 may be fired without the need for a wireline or other wired connection to the surface location to transmit an activation signal. Once activated, the perforating gun 100 may be dissolved in place in the wellbore 12, thereby eliminating the need for retrieval by wireline or other conveyance.

In the illustrated embodiment, the wellbore 12 extends through the various earth strata. Wellbore 12 has a substantially vertical section 14, and has a substantially horizontal section 18 that extends through a hydrocarbon bearing subterranean formation 20. As illustrated in FIG. 1, a casing string 16 is cemented in both the vertical and horizontal sections 14, 18. In other embodiments, portions of the wellbore may be open hole.

Positioned within wellbore 12 and extending from the surface is an optional conveyance such as a tubing string 22, wireline, coiled tubing, etc. The perforating gun 100 is untethered from the tubing string 22, but in some embodiments, may be lowered through the vertical section 14 on the tubing string 22 and untethered upon reaching the horizontal section 18. In other embodiments, the perforating gun 100 may be deployed untethered be from the surface without the tubing string 22, wireline or other conveyance.

Casing string 16 includes a plurality of couplings 26, 28, 30, 32, 34, each of which may include a passive depth marker, such as at least one array of magnets. The perforating gun 100 may be operable to detect the passive depth markers of the couplings 26, 28, 30, 32 34 and thereby identify a location of the perforating gun 100 as the perforating gun 100 is pumped through the in the wellbore 12. The perforating gun 100 may be responsive to identifying a predetermined depth in the wellbore 12 with the passive depth markers to fire or discharge one or more shaped perforating charges 110. In other embodiments, the perorating gun 100 is responsive to a wireless signal transmitted from the surface to cause the perforating gun 100 to fire. In other embodiments, the perforating gun 100 may be induced to fire in response to detecting a predetermined pressure or any other detectable condition in the wellbore 12. As illustrated, each coupling 26, 28, 30, 32, 34 is positioned between potential frac package setting points 36, 38, 40, 42, 44, 46 thereby defining potential production intervals. In the illustrated embodiment, couplings 26, 28, 30, 32, 34 may serve to locate and position the perforating gun 100. Each coupling 26, 28, 30, 32, 34 may include a unique magnetic signature, or otherwise provide a uniquely identifiable signal, and in some embodiments, each coupling 26, 28, 30, 32, 34 include a similar magnetic signature or provide similar identifiable signal. In some embodiments, the magnetic signature is created with hard permanent magnets such as alnico, ferrite, or rare-earth magnets. In another embodiment, the magnetic signature is created from a passive electronic marker such as an RFID tag or a NFC tag.

The perforating gun 100 generally includes an initiator 102, a detonator 104 and a charge carrier 106 supporting a plurality of the shaped perforating charges 110 thereon. In some embodiments, between about 3 and about 3000 perforating charges 110 may be supported on a charge carrier 106. As illustrated in FIG. 1, the charge carrier 106 is illustrated as an elongate rod such that the perforating gun 100 may be recognized as an exposed strip gun. In other embodiments, the charge carrier 106 may take other forms including a tubular member or cover carrying the perforating charges therein (see, for example, FIG. 6A), or other forms without departing from the scope of the disclosure.

The initiator 102 includes an electronics package and a battery (see FIG. 6A) that may be constructed of dissolvable materials, may be produced from the wellbore, or may be destroyed within the wellbore 12 (see FIG. 2). As used herein, dissolvable materials are materials that may be dissolved or otherwise broken down by application of a selected wellbore fluid in a period of time, without destroying other downhole components made of other materials that are also contacted by the selected wellbore fluid in that same period of time. The parts made of such dissolvable materials may be effectively removed from service by dissolution or degrading, preferably without a need to retrieve them from the wellbore, within a practical period of time such as within days or even minutes of exposure to the selected wellbore fluid. In some embodiments, the components described as "dissolvable" may degrade within 2 weeks of exposure to the selected wellbore fluids such that individual particles remaining are less than about one half inch diameter.

Non-limiting examples of a "dissolvable material" include at least hydrolytically degradable materials such as elastomeric compounds that contain polyurethane, aliphatic polyesters, thiol, cellulose, acetate, polyvinyl acetate, polyethylene, polypropylene, polystyrene, natural rubber, polyvinyl alcohol, or combinations thereof. Aliphatic polyester has a hydrolysable ester bond and will degrade in water. Examples include polylactic acid, polyglycolic acid, polyhydroxyalkonate, and polycaprolactone. A "dissolvable material" may also include metals that have an average dissolution rate in excess of 0.01 mg/cm2/hr. at 200° F. in a 15% KCl solution. A component constructed of a dissolvable material may lose greater than 0.1% of its total mass per day at 200° F. in a 15% KCl solution. In some embodiments, the dissolvable metal material may include an aluminum alloy and/or a magnesium alloy. Magnesium alloys include those defined in ASTM standards AZ31 to ZK60. In some embodiments, the magnesium alloy is alloyed with a dopant selected from the group consisting of iron, nickel, copper and tin. A solvent fluid for a dissolvable material may include water, a saline solution with a predetermined salinity, an HCl solution and/or other fluids depending on the selection and arrangement of components constructed of the dissolvable material.

The electronics package of the initiator 102 sends an initiation signal to the detonator 104 when the perforating gun 100 has reached a predetermined location in the wellbore 12. The initiator 102 may detect the predetermined location in the wellbore 12, for example, with a magnetic detector operable to detect the magnetic field of the array of magnets associated with each coupling 26, 28, 30, 32, 34, and electronics arranged to count the number of couplings encountered or to identify the a unique magnetic signature of a specific one of the couplings 26, 28, 30, 32, 34. In other embodiments, the initiator 102 may include a wireless communication device to receive a telemetry signal from the surface or another location in the wellbore 12. Once the predetermined location has been identified and the initiation signal has been sent to the detonator 104, the detonator 104 creates a small explosion that is carried through a detonation cord 112 to each of the perforating charges 110. Each perforating charge 110 creates a jetted explosion that makes a hole in the casing 16. In some embodiments, the initiator 102 fires the perforating charges 110 in multiple stages with a short time between the stages. This may create more than one perforation cluster spaced along the wellbore 12, which may facilitate hydraulic fracturing. The perforating charges 110 may be circular or non-circular in cross-section and may include linear shaped charges or ovular shaped charges. The perforating charges may include any directed energy explosives including shaped charges, hemi charges, and explosively formed penetrators.

The detonator 104 is mechanically connected to the charge carrier 106, which may include an elongate strip, wire, cable, tube or rod extending axially between the shaped perforating charges 110. As illustrated, the perforating gun 100 is devoid of a tubular housing or hollow gun body extending around the shaped perforating charges 110. Thus, at least a portion of the perforating charges 110 are configured to be exposed to a wellbore fluid prior to firing of the perforating charges 110. For example, the perforating charges 110 may include an individual charge cover 310 (FIG. 3) as described in greater detail below.

The charge carrier 106 may be relatively thin and flexible, and thus subject to buckling loads if pushed from the detonator 104 downhole, for example, by a tubing string 22 or other conveyance pushing on the initiator 102 or detonator 104. The charge carrier 106 supports a wiper 114 thereon that extends radially to assist with the pumping into the wellbore 12. The wiper 114 is positioned generally at a distal or downhole end of the charge carrier 106, such that pumping a carrier fluid 116 against the wiper generally places the charge carrier 106 in tension, thereby reducing the likelihood of buckling in operation.

The wiper 114 may also serve to establish a standoff distance "D" between the perforating charges 110 and the casing string 16. In other embodiments, standoffs, centralizers, or other radially extending structures may be used to enforce a standoff distance for the perforating charges 110. Maintaining a minimum standoff distance "D" may enhance the formation a jet upon firing the perforating charges 110.

Figure 2A:
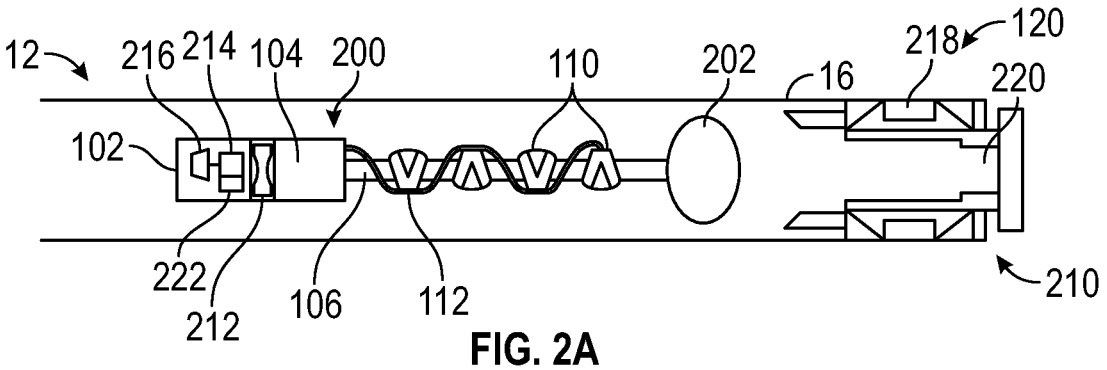
FIGS. 2A and 2B are schematic illustrations of alternate wellbore systems in which a dissolvable perforating gun includes a ball for landing in a frac plug previously set within the wellbore, a single plurality of shaped charges for creating perforations in wellbore (FIG. 2A) or multiple pluralities of shaped charges (FIG. 2B), and an explosive for fragmenting an electronics package carried by the perforating gun.

Referring to FIG. 2A, an alternate wellbore system 120 is illustrated in which a dissolvable perforating gun 200 includes a ball or sealing plug 202 for landing in a frac plug 210, which may have been previously set at a predetermined location within the wellbore 12 identified using the magnetic couplings 26, 28, 30, 32, 34 or other passive depth markers in the wellbore 12. The dissolvable perforating gun 200 includes a plurality of shaped perforating charges 110 for creating perforations in wellbore 12, and an additional electronics explosive 212 for fragmenting an electronics package 214 and battery 216 carried by the initiator 102 or another component of the perforating gun 200. As illustrated, the dissolvable perforating gun 200 is arranged with the initiator 102 at a proximal or uphole end thereof, the sealing plug 202 at a distal or downhole end thereof, with the detonator 104 and charge carrier 106 coupled therebetween. In other embodiments, the initiator 102, detonator 104 and/or charge carrier could be located at the proximal end, distal end or centrally located in the perforating gun 200 without departing from the scope of the disclosure.

The frac plug 210 includes a sealing element 218 engaging the casing string 16 or wellbore wall to form a seal therewith. A fluid passage 220 extending through the frac plug 210 may be sealed by landing the sealing plug 202 in the frac plug 210. In some embodiments, landing on the frac plug 210 may trigger the initiator 102 to send the initiation signal to the detonator 104. For example, a sensor 222 on the initiator 102 may detect an increase in pressure in the wellbore 12 due to the fluid passage 220 being blocked by the sealing plug 202. The electronics package 214 may include instructions stored thereon to send the initiation signal to the detonator 104 to fire the perforating charges 110 in response to detecting the increase in pressure. In some embodiments the sensor 222 may detect a proximity to the frac plug 210 to trigger the initiator 102 to send the initiation signal. For example, the sensor 222 may detect the magnetic couplings 26, 28, 30, 32, 34 (FIG. 1) and send the initiation signal in response to detecting a specific number of couplings or a identifying a specific magnetic signature of a specific magnetic coupling 26, 28, 30, 32, 34 at a predetermined location uphole of the frac plug 210. Thus, the perforating charges 110 may be fired at a predetermined distance from the frac plug 210.

In some embodiments, the initiation signal may command the detonator 104 to fire both the shaped perforating charges 110 and the additional electronics explosive 212 to destroy or fragment the electronics package 214, battery 216 and sensor 222 carried by the initiator 102. The additional electronics explosive 212 may be a shaped charge coupled to the detonation cord 112 and oriented to form a jet directed into the initiator 102. In other embodiments, the additional electronics explosive 212 may be a length of detonation cord wrapped around the electronics package 214, sensor 222 and battery 216 (see FIG. 6A) and may be fired independently from the shaped perforating charges 110. By fragmenting the electronics package 214, sensor 222 and battery 216 of the initiator 102, these components may be dissolved more easily, or may be fragmented to a size that will not interfere with production or other wellbore operations.

Figure 2B:
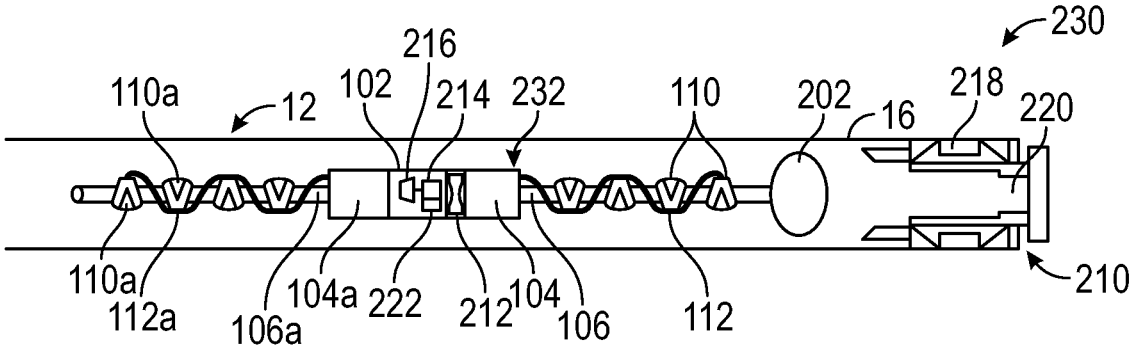

Referring to FIG. 2B, an alternate wellbore system 230 is illustrated in which a dissolvable perforating gun 232 includes a first set or plurality of shaped perforating charges 110 and at least one additional set or plurality of shaped perforating charges 110*a*. Similar to the perforating gun 200 described (FIG. 2A) above, the perforating gun 232 includes a sealing plug 202 for landing in frac plug 210, the plurality of shaped perforating charges 110 operably coupled to detonator 104, and the additional electronics explosive 212 for fragmenting electronics package 214 and battery 216 carried by the initiator 102. As illustrated in FIG. 2B, the dissolvable perforating gun 232 is arranged with the initiator 102 coupled between the detonator 104 and an additional detonator 104*a*. The initiator 102 is operable to send an initiation signal to either the detonator 104 to cause the detonation cord 112 and shaped perforating charges 110 carried by the charge carrier 106 to fire, to cause the detonation cord 112*a* and shaped perforating charges 110*a* carried by charge carrier 106*a* to fire, and/or to cause additional electronics explosive 212 to fire.

Figure 3:
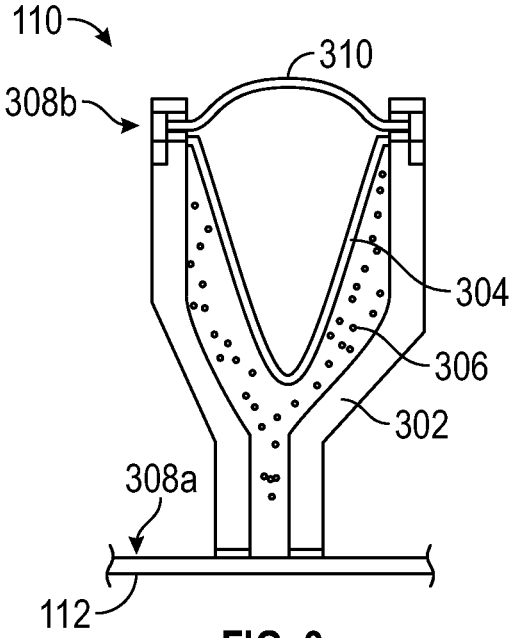
FIG. 3 is a cross-sectional view of one of the shaped charges of FIG. 2, illustrating a charge cover disposed over a liner of the shaped charge.

Although only one additional set of perforating charges 110*a* are illustrated, any number of additional charge carriers 106*a*, detonation cords 112*a* and shaped perforating charges 110*a* may be provided without departing from the scope of the disclosure. In operation, the initiator 102 may first cause the shaped charges 110*a* to fire before, after or simultaneously with the shaped charges 110. For example, the shaped perforating charges 110*a* may be fired in response to detecting a predetermined passive depth marker in the wellbore 12, and the shaped perforating charges may be fired after a predetermined time delay, in response to detecting an additional passive depth marker in the wellbore 12, or in response to detecting engagement of the sealing plug 202 with the frac plug 210. Referring to FIG. 3, a cross-sectional view of one of the shaped perforating charges 110, which may be employed on the expendable and/or dissolvable perforating guns 100, 200 described above. The shaped perforating charge 110 includes a charge casing 302 forming an outer housing of the charge 110 and a liner 304 forming an inner housing of the charge 110. Between the charge casing 302 and the liner 304 is a high explosive powder 306 that may be detonated via the detonator cord 112 at an initiation end 308*a* of the perforating charge 110. The perforating charges 110 each have an individual charge cover 310 extending over the liner 304 and coupled to the charge casing 302 at a discharge end 308*b* of the perforating charge 110. The charge cover 310 may be constructed of a plastic material that will not react to fluids in the wellbore 12 (FIG. 1) and may thus protect liner 304 until the perforating charge 110 is fired. The liner 304 may then form a jet unimpeded by wellbore fluids and metallic slug for generating an effective perforation cluster as described below.

Figure 4D:
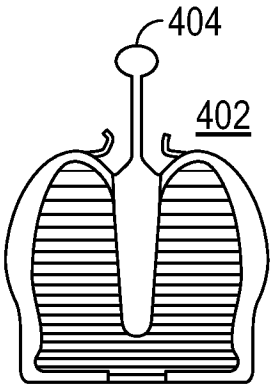
FIGS. 4A through 4D are cross-sectional views of the shaped charge of FIG. 3 illustrating a detonation sequence of the shaped charge.
Figure 4C:
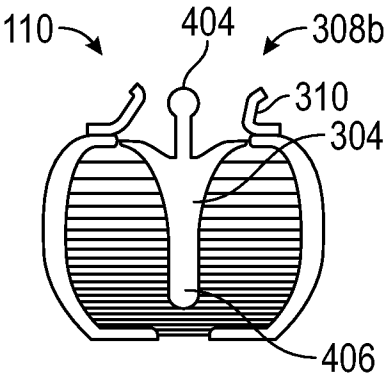
Figure 4B:
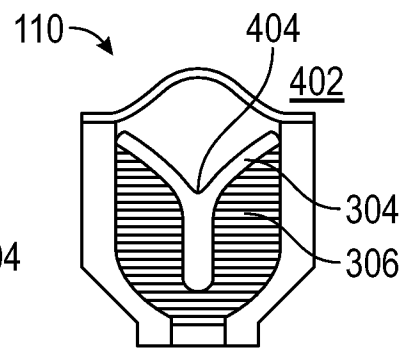
Figure 4A:
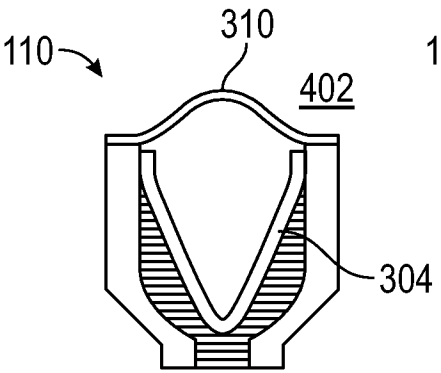

Referring to FIGS. 4A through 4D, a detonation sequence of the perforating charge 110 is illustrated in which the charge cover 310 allows a perforating jet to form without the influence or limitations of the wellbore fluid 402. FIG. 4A illustrates the perforating charge 110 prior to detonation. The perforating charge 110 is exposed to the wellbore fluids 402 since the perforating guns 100, 200 are devoid of a hollow gun body surrounding the carrier 106 (FIGS. 1 and 2). The charge cover 310 fluidly isolates the liner 304 from the wellbore fluids 402. FIG. 4B illustrates the perforating charge 110 once the high explosive powder 306 is detonated. At this point, the liner 304 collapses inward to form a jet 404 without the influence of the wellbore fluid 402. As illustrated in FIG. 4C, the jet 404 is propelled outward from the discharge end 308*b* of the shaped charge 110. The jet 404 penetrates the charge cover 310 while the later stages of the liner 304 collapse to form a slower moving slug 406. Referring to FIG. 4D, the jet 404 stretches outward into the wellbore fluid 402 toward the casing string 16 (FIGS. 1 and 2).

Figure 5:
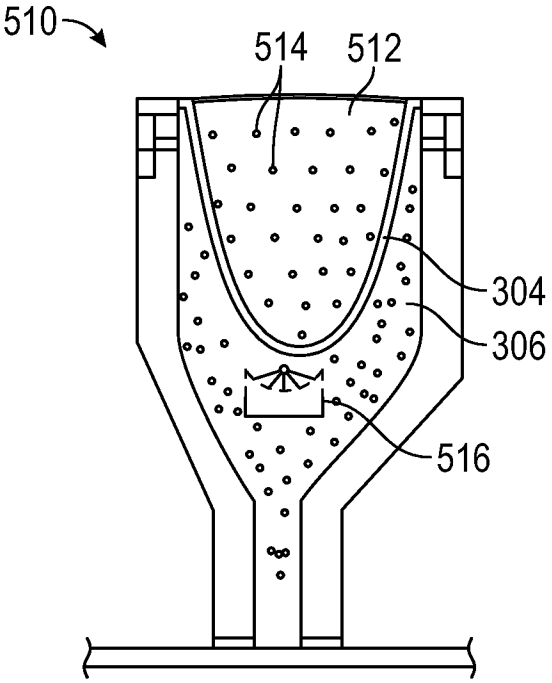
FIG. 5 is a cross-sectional view of an alternate shaped charge in which a low-density filler is disposed over the liner.

Referring to FIG. 5, an alternate embodiment of shaped perforating charge 510 is illustrated in which a low-density filler 512 is disposed over the liner 304. The low-density filler 512 may include materials with a density less than about 3 g/cc, and in some embodiments, less than about 0.6 g/cc. For example, the low-density filler 512 may include a foam, a plastic, or a wax impregnated with hollow glass microspheres 514. As illustrated, the perforating charge 510 also includes a waveshaper body 516. The waveshaper body 516 is an inert material that is disposed within the high explosive powder 306 for the purpose of modifying the collapse of the liner 304 and the formation of the resulting jet 404 (see FIG. 4C). A waveshaper body 516 may exhibit any geometry or placement with in the explosive powder 306 to focus, delay or redirect a detonation wave to form a jet 404 with desired predetermined characteristics.

Figure 6A:
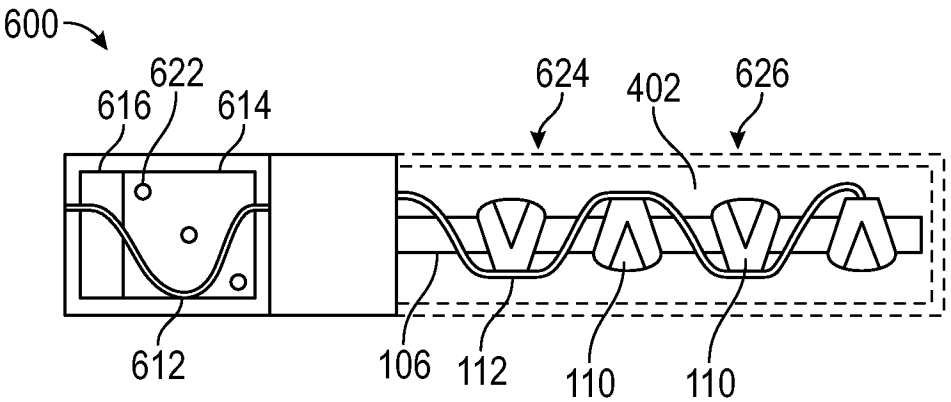
FIG. 6A is a schematic view of an alternate perforating gun in which a detonation cord is employed to fragment an electronics package carried by the perforating gun.

Referring to FIG. 6A, an alternate embodiment of perforating gun 600 is illustrated in which a detonation cord 612 is employed to fragment an electronics package 614 and battery or other power supply 616 carried by the initiator 102. The detonation cord 612 may be detonated along with the detonation cord 112 coupled to perforating charges 110, or the detonation cord 612 may be detonated independently of the detonation cord 112 and perforating charges 110 depending on instructions stored in the electronics package 614. The detonation cord 612 may fragment the electronics package 614 and battery 616 alone or may ignite secondary energetic materials 622 integrated into the electronics package 614 and battery 616. The secondary energetic materials 622 may be pucks, disks, wafers, or flexible explosive sheets arranged to optimize the fragmentation. Some arrangements for secondary energetic materials are illustrated in FIGS. 6B and 6C.

Figure 6C:
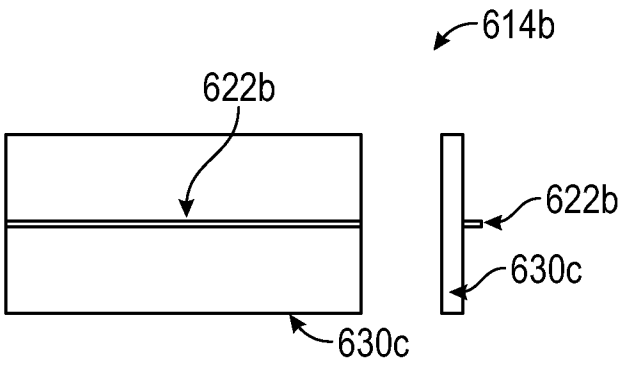
FIGS. 6B and 6C are orthogonal views of alternate embodiments of an electronics package including secondary energetic materials for fragmenting the electronics package.
Figure 6B:
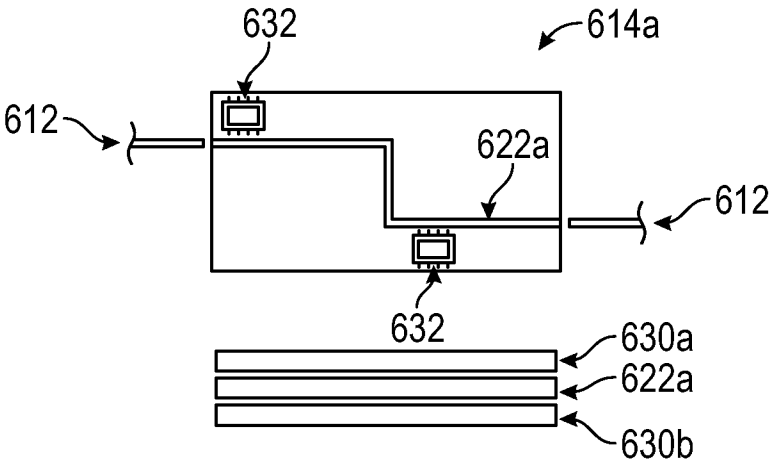

Referring to FIG. 6B, an electronics package 614*a* includes a secondary energetic material 622*a* sandwiched between upper and lower substrate layers 630*a*, 630*b*. The substrate layers 630*a*, 630*b* may be constructed of an epoxy resin reinforced with glass fibers. The substrate layers 630*a*, 630*b* may include a copper foil bonded on to one or both sides that may electrically connect various electronic components 632 mounted on the substrate layers 630*a*, 630*b* that may issue initiation signals, detect passive depth markers, calculate time delays, and perform the electronic functions of the electronics package 614*a*. The secondary energetic material 622*a* may be routed across the substrate layers 630*a*, 630*b* in a circuitous, branching or serpentine path, such that the secondary energetic material 622*a* forms a path between the electronic components 632. Thus, upon detonation, the secondary energetic material 622*a* may effectively fragment the electronic components 632 and the substrate layers 630*a*, 630*b*. The secondary energetic material 622*a* may be operatively coupled to the detonation cord 612 at the edges of the substrate layers 630*a*, 630*b* such that the detonation cord 612 may detonate the secondary energetic material 622*a*, and the secondary energetic material 622 may detonate a portion of detonation cord 612 that continues on to other portions of the perforation gun 600 (FIG. 6A).

Referring to FIG. 6C, an electronics package 614*b* includes a secondary energetic material 622*b* extending along an outer surface of a substrate 630*c*. The secondary energetic material 622*b* may generally bisect the substrate layer 630*c* and extend between opposite edges of the substrate layer 630*c* to facilitate fragmentation of the substrate layer 630*c* and any electronic components supported thereon.

Referring again to FIG. 6A, in some embodiments, the electronics package 614 and power supply 616 may be constructed of dissolvable materials, which may dissolve in the presence of an acid. Thus, in some embodiments fragmented pieces of the components electronics package 614 and power supply 616 may be dissolved in place or may be produced back to the surface by the circulation of wellbore fluids 402.

The perforating gun 600 also includes a sleeve 624 disposed over the charge carrier 106. The sleeve 624 may be a non-pressure containing housing, so it does not keep wellbore fluids 402 away from the perforating charges 110. However, the sleeve 624 is useful for protecting the detonation 112 cord from abrasion and mishandling during installation. The sleeve 624 is constructed of a dissolvable material. The sleeve 624 can be constructed as a solid cylinder or it can have holes 626 therein such as to from a mesh or a shroud. In some embodiments, the sleeve 624 is constructed from an extruded plastic or a cast elastomer.

In some embodiments, the dissolvable perforating guns 100, 200, 600 described herein are composed of multiple materials such as a combination of dissolvable metal, dissolvable plastic, and dissolvable elastomers. For example, the liner 304, charge cover 310, and charge casing 302 (FIG. 3) could be composed of a dissolvable metal. A mechanical linkage coupling the detonator 104 to the charge carrier 106 could be composed of dissolvable polymer. The wiper 114 (FIG. 1) or centralizers could be composed of a dissolvable polymer. In proppant fracturing operations, the fracturing is often started with acid. In acid fracturing and combo fracturing, acid is used extensively. The acid can be an organic acid such as carboxylic acid, citric acid, formic acid, and acetic acid. The acid can be an inorganic acid such as hydrochloric acid and nitric acid. By constructing parts of the perforating gun 100, 200, 600 from a dissolvable metal, the acid will accelerate their dissolution. As a result, these parts will dissolve early in the fracturing or stimulation process.

Examples of dissolvable plastic include aliphatic polyesters, specifically PGA and PLA plastic. Examples of dissolvable elastomer include polyurethane, thermoplastic urethane (TPU), and thiol. Examples of dissolvable metal include magnesium alloys, aluminum alloys, and zinc alloys. Examples of non-dissolvable materials include steel, brass, ceramic, cast iron. The dissolvable materials may be coated to inhibit the degradation process. Coatings include a metal coating (like nickel), a polymer coating (like plastic, paint, etc.).

Figure 7:
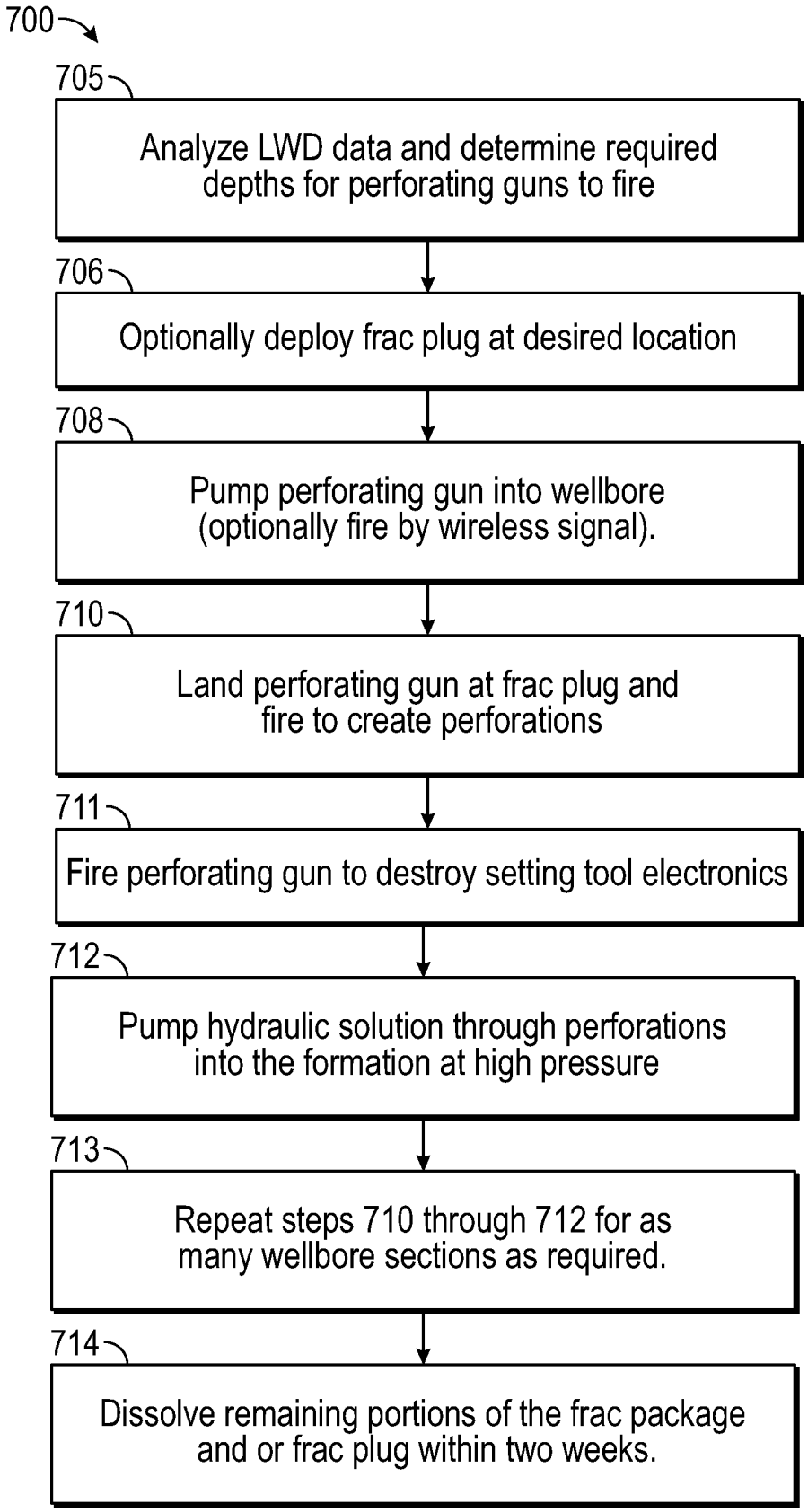
FIG. 7 is a block diagram illustrating a process of deploying the untethered dissolvable perforating gun and performing a hydraulic fracturing operation in the wellbore.

FIG. 7. is a block diagram illustrating a process 700, which may be employed to deploy an untethered dissolvable perforating gun 100, 200, 600 in the wellbore 12 and performing a hydraulic fracturing or stimulation operation. Initially at step 705, logging while drilling (LWD) or other data may be analyzed to determine appropriate wellbore locations for the frac plugs 210 and for perforations to be formed. At step 706 a frac plug 210 may be deployed and set in the wellbore 12 in response to detecting one or more of the magnetic couplings 26, 28, 30, 32, 34 or other passive depth markers in the wellbore 12. In step 708, the dissolvable perforating gun 100, 200, 600 is pumped into the wellbore in toward the frac plug 210 or another predetermined location. In other embodiments, the frac plug 210 may be pumped together with a perforating gun 100, 200, 600 in step 708. If the initiator 102 detects an appropriate magnetic coupling 26, 28, 30, 32, 34, one or more of the shaped charges 110 may be fired while the perforating gun 100, 200, 600 is in motion. At step 710, the perforating gun 100, 200 600 may be landed at the frac plug 210 and fired to create perforations in the wellbore 12. At step 711, the additional electronics explosive 212 and/or secondary energetic materials 622 may be ignited to destroy the electronics package 614 and power supply 616.

At step 712, a selected wellbore fluid is pumped against the frac plug 210 and sealing plug 202, through the perforations into the geologic formation at high pressures. The selected wellbore fluid may be a hydraulic solution, for example, a proppant filled-fracturing fluid and/or an acid solution. The hydraulic solution may dissolve wormholes in the geologic formation and/or fracture the formation due to the pumping pressure. The hydraulic solution may also operate to dissolve remaining components of the perforating gun 100, 200, 600. At step 713, steps 710 through 712 may be repeated to isolate any number of wellbore regions or zones, and to conduct acid fracturing operations in those zones. Portions of the perforating gun 100, 200, 600 may dissolve during step 713, but the frac plug 210 and sealing plug 202 may remain intact. At step 714, any remaining portions of the perforating gun 100, 200, 600 and/or dissolvable frac plug 210 may dissolve within 2 weeks such that any remaining individual particles of the frac plug 210 are less than about one half inch diameter.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

According to one aspect, the disclosure is directed to an untethered perforating gun apparatus for creating perforations in a wellbore. The apparatus includes an elongated charge carrier, a plurality of perforating charges supported on an exterior surface of the elongated charge carrier, a detonator operably coupled to the one or more perforating charges to selectively fire the perforating charges in response to receiving an initiation signal; and an initiator operable to transmit the initiation signal to the detonator in response to wirelessly detecting a signal indicative of the perforating gun reaching a predetermined depth in the wellbore. Each of the elongated charge carrier, perforating charges, detonator and initiator are constructed of a material dissolvable within the wellbore.

In one or more embodiments, the apparatus includes multiple charge carriers, each charge carrier supporting a plurality of perforating charges thereon. Each of the pluralities of perforating charges may be fired independently of one another. In some embodiments, the apparatus is devoid of a fluidly sealed housing around the plurality of perforating charges such that at least a portion of the plurality of perforating charges are exposed to a wellbore fluid in operation prior to firing of the perforating charges. One or more of the perforating charges may include a charge cover coupled to a charge casing thereof, the charge cover extending over a liner to isolate the liner from the wellbore fluid. One or more of the perforating charges may include a filler material disposed within a concavity of a liner of the perforating charge, the filler material having a density of less than about 3 g/cc. In some embodiments, the apparatus further includes a sleeve disposed over the charge carrier, the sleeve having holes therein permitting wellbore fluids to pass into the sleeve.

In some embodiments, the apparatus further includes an electronics explosive adjacent the initiator arranged for selectively fragmenting an electronics package and power supply carried by the initiator. The electronics explosive may include at least one of the group consisting of a shaped charge and a length of detonation cord wrapped around the electronics package and power supply. The electronics package may include secondary energetic materials integrated therein and arranged to ignite in response to detonating the electronics explosive. In some embodiments, a secondary energetic material is sandwiched between substrate layers of the electronics package. The secondary energetic materials may extend along a circuitous path through or along the substrate layer to effectively fragment the substrate layer and any electronic components supported thereon. In some embodiments, the secondary energetic materials are operably coupled to a detonation cord such that the secondary energetic materials ignite upon detonation of the detonation cord. In some embodiments, the secondary energetic materials extend across an outer surface of a substrate layer between edges of the substrate layer.

In one or more embodiments, the apparatus further includes a wiper, standoff or other radially protruding member coupled to a distal end of the elongated charge carrier to place the elongated charge carrier in tension when the apparatus is pumped downhole in a carrier fluid. In some embodiments, the apparatus further includes a sealing plug carried at a distal end of the perforating gun for landing in a fluid passageway of a frac plug set at a predetermined location in the wellbore.

According to another aspect, the disclosure is directed to a method for perforating a wellbore and conducting hydraulic operations therein. The method includes conveying an untethered perforating gun into the wellbore, the perforating gun including one or more perforating charges coupled to an exterior of an elongate charge carrier, wirelessly detecting a predetermined depth in the wellbore with an initiator carried by the perforating gun detonating the one or more perforating charges in response to wirelessly detecting the predetermined depth and dissolving the perforating gun in the wellbore.

In some embodiments, the method further includes detonating an electronics explosive to fragment an electronics package and a power supply of the initiator. In some embodiments, detonating the one or more perforation charges includes penetrating a charge cover coupled to a charge casing with a jet formed by collapsing a liner of the perforating charge.

In one or more embodiments, the method further includes pumping a hydraulic fluid into the wellbore at a pressure between about 1000 psi to about 5 ksi to fracture a geologic formation surrounding the wellbore. The method may further include pumping an acid into the wellbore. The method may further include landing the perforating gun in a frac plug deployed in the wellbore. In some embodiments, wirelessly detecting the predetermined depth in the wellbore comprises detecting a magnetic signature of an array of magnets disposed in a casing string.

According to another aspect, the disclosure is directed to a system for perforating a wellbore and conducting hydraulic operations therein. The system includes an untethered perforating gun constructed of a dissolvable material and movable in the wellbore with a carrier fluid, the perforating gun including an elongated charge carrier supporting a plurality of perforating charges on an exterior surface thereof, a detonator carried by the perforating gun, the detonator operably coupled to the one or more perforating charges to selectively fire the perforating charges in response to receiving an initiation signal, an initiator carried by the perforating gun, the initiator operable to transmit the initiation signal in response to the perforating gun reaching a predetermined depth in the wellbore, and a frac plug deployed in the wellbore to isolate a wellbore region in which the perforating gun is carried by the carrier fluid.

In some embodiments, the initiator includes a sensor for detecting the predetermined depth in the wellbore. The system may further include a sealing plug for sealing a fluid passage extending through the frac plug, and wherein the sensor is operable to detect engagement of the sealing plug with the frac plug.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. An untethered perforating gun apparatus for creating perforations in a wellbore, the apparatus comprising:

a sealing plug carried at a distal end of the perforating gun for landing in a fluid passageway of a frac plug set at a predetermined location in the wellbore;

an elongated charge carrier;

a plurality of perforating charges supported on an exterior surface of the elongated charge carrier;

a detonator operably coupled to the one or more perforating charges to selectively fire the perforating charges in response to receiving an initiation signal; and an initiator operable to transmit the initiation signal to the detonator in response to wirelessly detecting a signal indicative of the perforating gun reaching a predetermined depth in the wellbore, wherein each of the elongated charge carrier, perforating charges, detonator and initiator are constructed of a material dissolvable within the wellbore.

2. The apparatus according to claim 1, wherein the apparatus is devoid of a fluidly sealed housing around the plurality of perforating charges such that at least a portion of the plurality of perforating charges are exposed to a wellbore fluid in operation prior to firing of the perforating charges.

3. The apparatus according to claim 2, wherein one or more of the perforating charges includes a charge cover coupled to a charge casing thereof, the charge cover extending over a liner to isolate the liner from the wellbore fluid.

4. The apparatus according to claim 2, wherein one or more of the perforating charges includes a filler material disposed within a concavity of a liner of the perforating charge, the filler material having a density of less than about 3 g/cc.

5. The apparatus according to claim 2, further comprising a sleeve disposed over the charge carrier, the sleeve having holes therein permitting wellbore fluids to pass into the sleeve.

6. The apparatus according to claim 1, further comprising an electronics explosive adjacent the initiator arranged for selectively fragmenting an electronics package and power supply carried by the initiator.

7. The apparatus according to claim 6, wherein the electronics explosive comprises at least one of the group consisting of a shaped charge and a length of detonation cord wrapped around the electronics package and power supply.

8. The apparatus according to claim 6 wherein the electronics package comprises secondary energetic materials integrated therein and arranged to ignite in response to detonating the electronics explosive.

9. The apparatus according to claim 1, further comprising a wiper, standoff or other radially protruding member coupled to a distal end of the elongated charge carrier to place the elongated charge carrier in tension when the apparatus is pumped downhole in a carrier fluid.

10. A method for perforating a wellbore and conducting hydraulic operations therein, the method comprising:

conveying an untethered perforating gun into the wellbore, the perforating gun including one or more perforating charges coupled to an exterior of an elongate charge carrier, wirelessly detecting a predetermined depth in the wellbore with an initiator carried by the perforating gun;

landing the perforating gun in a fluid passageway of a frac plug set at a predetermined location in the wellbore using a sealing plug carried at a distal end of the perforating gun;

detonating the one or more perforating charges in response to wirelessly detecting the predetermined depth; and dissolving the perforating gun in the wellbore.

11. The method according to claim 10, further comprising detonating an electronics explosive to fragment an electronics package and a power supply of the initiator.

12. The method according to claim 10, wherein detonating the one or more perforation charges comprises penetrating a charge cover coupled to a charge casing with a jet formed by collapsing a liner of the perforating charge.

13. The method according to claim 10, further comprising pumping a hydraulic fluid into the wellbore at a pressure between about 1000 psi to about 5 ksi to fracture a geologic formation surrounding the wellbore.

14. The method according to claim 13, further comprising pumping an acid into the wellbore.

15. The method according to claim 10, wherein wirelessly detecting the predetermined depth in the wellbore comprises detecting a magnetic signature of an array of magnets disposed in a casing string.

16. A system for perforating a wellbore and conducting hydraulic operations therein, the system comprising:

an untethered perforating gun constructed of a dissolvable material and movable in the wellbore with a carrier fluid, the perforating gun including an elongated charge carrier supporting a plurality of perforating charges on an exterior surface thereof;

a detonator carried by the perforating gun, the detonator operably coupled to the one or more perforating charges to selectively fire the perforating charges in response to receiving an initiation signal;

an initiator carried by the perforating gun, the initiator operable to transmit the initiation signal in response to the perforating gun reaching a predetermined depth in the wellbore; and a frac plug deployed in the wellbore at the predetermined depth to isolate a wellbore region in which the perforating gun is carried by the carrier fluid, wherein the frac plug comprises a fluid passageway; and a sealing plug carried at a distal end of the perforating gun for landing in the fluid passageway of the frac plug.

17. The system according to claim 16, wherein the initiator includes a sensor for detecting the predetermined depth in the wellbore.

18. The system according to claim 17, wherein the sealing plug is configured to seal the fluid passageway extending through the frac plug, and wherein the sensor is operable to detect engagement of the sealing plug with the frac plug.

19. The system according to claim 16, wherein the perforating gun is devoid of a fluidly sealed housing around the plurality of perforating charges such that at least a portion of the plurality of perforating charges are exposed to a wellbore fluid in operation prior to firing of the perforating charges.

20. The system of claim 19, wherein one or more of the perforating charges includes a charge cover coupled to a charge casing thereof, the charge cover extending over a liner to isolate the liner from the wellbore fluid.

* * * * *